US011066885B2

(12) United States Patent
Scott

(10) Patent No.: US 11,066,885 B2
(45) Date of Patent: Jul. 20, 2021

(54) FLUID LOCK PIN APPARATUS

(71) Applicant: Michael D. Scott, Oklahoma City, OK (US)

(72) Inventor: Michael D. Scott, Oklahoma City, OK (US)

( * ) Notice: Subject to any disclaimer, the term of this patent is extended or adjusted under 35 U.S.C. 154(b) by 272 days.

(21) Appl. No.: 16/165,437

(22) Filed: Oct. 19, 2018

(65) Prior Publication Data

US 2020/0123864 A1 Apr. 23, 2020

(51) Int. Cl.
*E21B 23/04* (2006.01)
*E21B 23/02* (2006.01)

(52) U.S. Cl.
CPC ..... *E21B 23/04* (2013.01); *E21B 23/02* (2013.01)

(58) Field of Classification Search
CPC ..... E21B 23/04; E21B 23/033; E21B 33/04; E21B 33/038
See application file for complete search history.

(56) References Cited

U.S. PATENT DOCUMENTS 3,215,454 A * 11/1965 Hayes ..... E21B 17/01 285/23
4,770,250 A * 9/1988 Bridges ..... E21B 33/04 166/382
7,159,663 B2 * 1/2007 McGuire ..... E21B 33/038 166/368
8,146,552 B2 * 4/2012 Seitz ..... F01L 1/185 123/90.44
9,556,698 B2 * 1/2017 Nguyen ..... E21B 23/01
2003/0145995 A1 * 8/2003 Andersen ..... E21B 33/038 166/345
2009/0078225 A1 * 3/2009 Hendriksma ..... F01L 13/0036 123/90.39
2011/0011599 A1 * 1/2011 Nguyen ..... E21B 33/00 166/386
2012/0012341 A1 * 1/2012 White ..... E21B 33/12 166/386

* cited by examiner

*Primary Examiner* — Steven A MacDonald
(74) *Attorney, Agent, or Firm* — Edward L. White

(57) ABSTRACT

A fluid-actuated lock pin securing wellhead devices within a wellhead assembly comprising a radial cylindrical passage in a wellhead assembly accepting a movable lock pin having an internal retainer limiting the lock pin protrusion into a wellbore, an external retainer preventing the lock pin from externally exiting the passage, and a fluid cavity, the lock pin with a seal preventing fluid from escaping from the wellbore, a fluid, a fluid pump applying pressure directly to the lock pin, a pressure control retaining the fluid pressure to maintain the lock pin in position, and a pin retractor to disengage the lock pin from the wellbore whereby the apparatus is configured to apply pressure directly to the lock pin displacing the lock pin inside in the well head assembly and extending into the wellbore to engage internal wellhead devices and hold fixedly in place, until the pressure is removed.

11 Claims, 6 Drawing Sheets

FLUID LOCK PIN APPARATUS

CROSS-REFERENCE TO RELATED APPLICATIONS

None

FIELD OF THE INVENTION

The invention generally relates to oil and gas well drilling and servicing and specifically, to a lock pin for a wellhead assembly. In particular, the invention relates to fluid pin lock system for securely retaining pack-offs, tubing heads, and other pin-secured devices within a wellhead assembly.

BACKGROUND

A conventional means for securing a series of wellhead devices including, but not limited to, mandrels, pack-offs, hangers, slips, and bushings internal to a wellhead assembly is by the use of a plurality of lock pins. The lock pins are threaded through the gland nuts that are threaded externally into the wellhead assembly and the lock pins then extend through radial passages in the wellhead, which are threaded. Each lock pin has a conical nose that engages a shoulder of one of the wellhead devices described above. Rotating the lock screw causes the nose to bear against the wellhead device, wedging it tightly in the wellhead against upward force. The gland nut secures the lock pin into place and prevents it from disengaging during normal operations.

Each of the lock pins are installed one-at-a-time. One disadvantage of this design and method of installation, is that it requires a sufficient number of threaded lock pins to be installed to secure the wellhead device safely in place without a significant safety concern. Additionally, this sequential method requires a significant amount of time to install the lock pins or if done in parallel by multiple workers at once a significant amount of manpower.

Currently removal of a lock pin can be hazardous and potentially deadly as seen through several fatal accidents. As a lock pin that is under pressure is unthreaded, a technician could unthread the lock pin sufficiently so that the lock pin becomes disengaged from the wellhead assembly and if under pressure, becomes make it a deadly projectile.

SUMMARY OF THE INVENTION

The present invention overcomes these shortcomings by providing a lock pin that is not rotated to secure the wellhead device within the wellhead assembly. The lock pin moves linearly from an outer position into an engaged position, compressing a disengagement spring where the nose of the lock pin engages the wellhead device. A fluid pump is attached to a distribution system that is coupled to all the lock pins for that specific device. The fluid pump through a wellhead assembly applies an inward force to the lock pin to move it to the inner position. Once in the inner position, the fluid pressure is maintained on the lock pin using a check valve at the fluid pump connection on the wellhead assembly. Moving the lock pins into their operating positions can be accomplished individually or preferably simultaneously. The fluid pump assembly can then be removed from the wellhead, and the check valve maintains the pressure to secure the lock pins in the engaged position.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE DRAWINGS

FIG. 6 is a sectional view of a pack-off.

DETAILED DESCRIPTION OF THE INVENTION

The fluid lock pin apparatus may comprise a series of fluid lock pins to secure a plethora of the internal wellhead devices in desired positions within a wellhead assembly. The fluid lock pin may be integrated into various wellhead components of a wellhead assembly including, but not limited to, flanges, casing heads, spools, casing spools, tubing head, or tubing head adapters. The fluid lock pins once pressurized engages various wellhead devices internal to the wellhead assembly including, but not limited to, mandrels, pack-off, hangers, slips, and bushings. The wellhead devices are typically under pressure and the fluid lock pin apparatus prevent the wellhead devices from moving longitudinally and potentially creating a malfunction within the wellhead assembly or a hazardous condition to personnel. The fluid lock pin apparatus may be retro-fitted into wellhead components such as flanges, casing heads, spools, casing spools, tubing head, or tubing head adapters that currently use the threaded lock pin.

The fluid lock pins on a wellhead assembly may be engaged individually or simultaneously. In the preferred embodiment, the fluid lock pins are engaged simultaneously saving significant labor costs required to engage conventional pins. Even where the user choses to engage the fluid lock pins individually, the overall labor cost is reduced. The ability to engage the fluid lock pins simultaneously adds an additional degree of safety around the wellhead assembly where an unexpected change in the wellbore occurs. The user may connect a distribution block and pump before inserting the wellhead device and quickly engage the wellhead device as required depending on the changing conditions in the wellbore.

Figure 1:
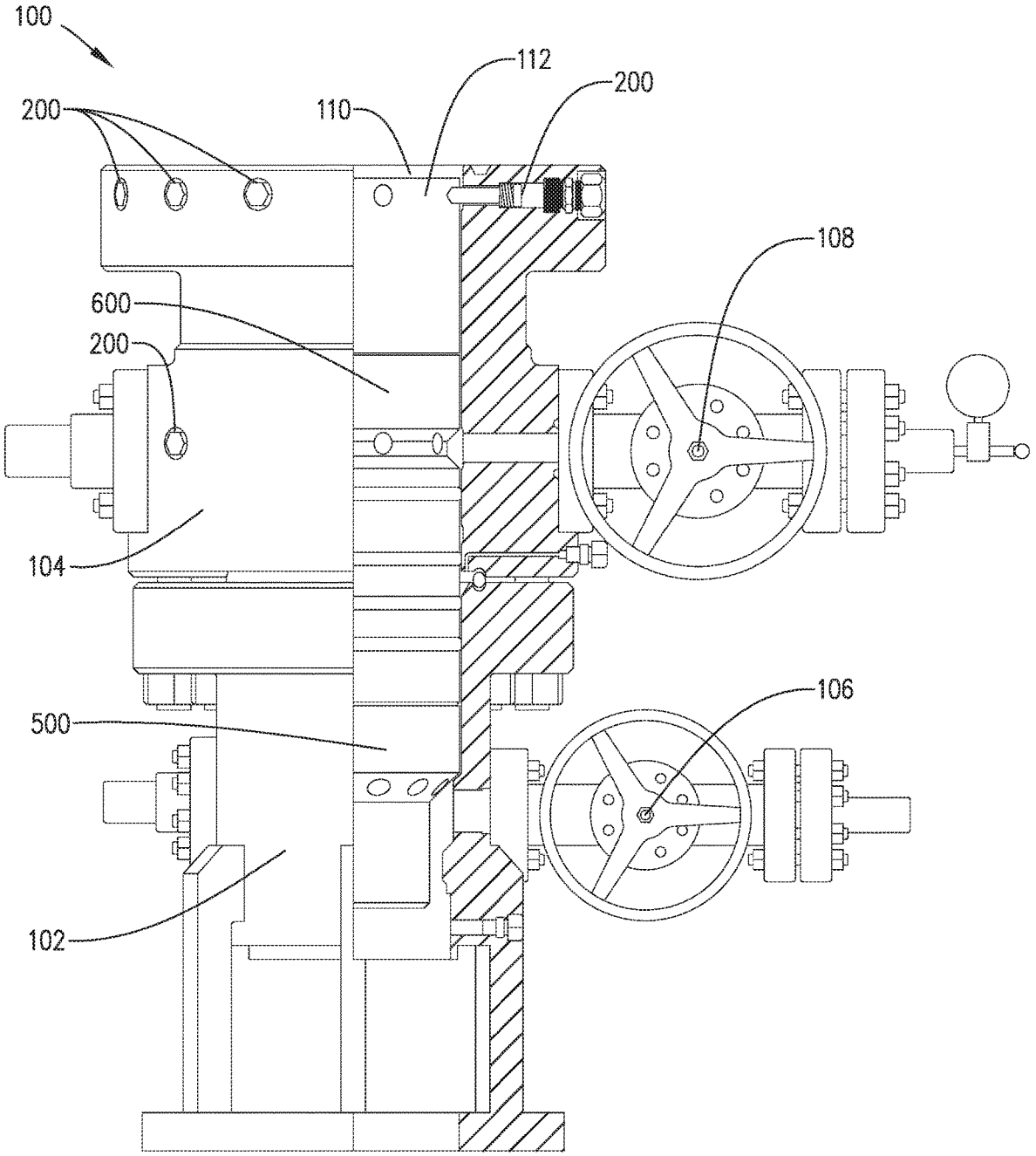
FIG. 1 is a side view, half in longitudinal cross-section, of the wellhead assembly showing the improved fluid lock pin apparatus.

FIG. 1 is a view, half in elevation and half in longitudinal section, of a wellhead assembly 100 showing the improved fluid lock pin apparatus. A wellhead assembly 100 preferably comprises a casing head 102, a casing spool 104, a fluted mandrel 500, a pack-off 600 with an annulus valve 106 and a production string valve 108 that is fluidly connected to the wellbore 110. Within the wellhead assembly 100, a plurality of fluid lock pins 200 may be integrated with various wellhead components for securing internal wellhead devices in position. The number of fluid lock pins 200 required is determined by the amount of pressure applied to wellhead components from the well. The fluid lock pins 200 may be evenly spaced around the wellbore 110 and extend radially from the exterior of the wellhead component, traversing the wellhead component, then protruding into the interior of the wellbore 110. In this preferred embodiment, a set of fluid lock pins 200 may be used to retain various wellhead devices internally to the wellhead assembly 100 including but not limited to mandrels, pack-offs, hangers, slips and bushings.

In FIG. 1, a casing spool 104 has two sets of fluid lock pins 200, a first set of fluid lock pins 200*a* ("lower lock pins") positioned at the same level as the production string valve 108 and the second set of fluid lock pins 200 ("upper lock pins") is positioned within the top flange of the casing spool 104. The lower lock pins 200 engage the pack-off 600 and maintain the pack-off 600 in the desired operating position thus preventing its movement longitudinally within the wellbore 110. The upper lock pins 200 engage a tubing hanger 112 by engaging corresponding holes in the tubing hanger 112 to maintain the desired position and prevent the tubing hanger 112 from dislocation from its operating position by the well pressure.

These wellhead devices as described above may operate under extreme pressures and the pressure applied attempts to force the device out of the wellhead assembly 100, thus creating a danger during normal operations. The fluid lock pin assembly 200 maintains the wellhead device in a desired position by applying pressure from the nose 403 of the movable pin 202 against the wellhead device surface in the case of a pack-off 600 or through a corresponding hole as in the case of a tubing hanger 112 within the casing spool 104 to prevent movement of the wellhead device.

Figure 2:
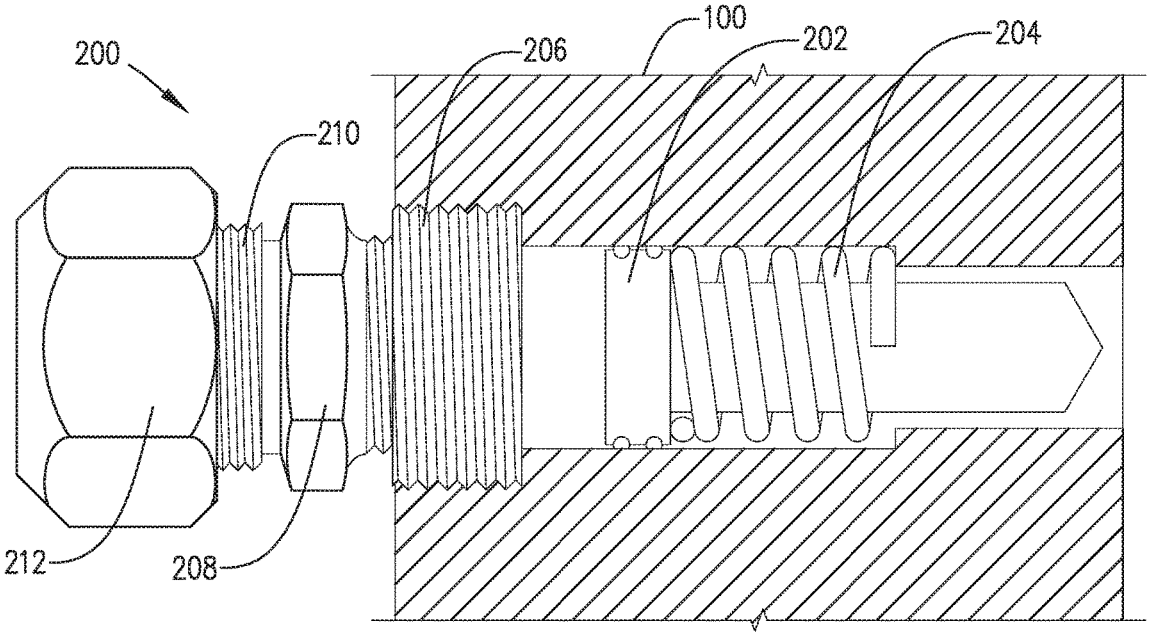
FIG. 2 is a partial sectional view of an unpressurized fluid lock pin in a wellhead assembly.

FIG. 2 is a partial cross-sectional side view of an unpressurized fluid lock pin assembly 200 in a wellhead assembly 100. The fluid lock pin assembly 200 may comprise a movable pin 202, a spring 204, a threaded pin retainer 206, a threaded check valve 208 having a threaded pressure connection 210 for receiving and releasing the pressurized fluid 304 and a threaded cap 212. The movable pin 202 may reside within the fluid lock pin housing 413. The movable pin 202 partially fills the fluid lock pin housing 413. The movable pin 202 and the pin housing 413 will be described in greater detail in FIG. 4. The fluid lock pin assembly 200 moves radially within the fluid lock pin housing 413 toward the center of the wellbore 110 to engage and disengage wellhead devices within the wellbore 110 that have been described above.

In the preferred embodiment, this particular view illustrates the fluid lock pin assembly 200 in a non-pressurized position within a wellhead assembly 100 where the spring 204 is decompressed and forced the movable pin 202 radially from the center of the wellbore 110 toward the exterior of the wellhead assembly 100 removing the nose 403 and pin shaft 402 from the wellbore 110 releasing the wellhead devices that it had previously retained. In the disengaged position, the fluid lock pin housing 413 may completely encompass the movable pin 202. The spring 204 inner diameter may be sized to loosely encompass the pin shaft 402 and not restrict or bind the movable pin's 202 travel beyond the designed resistance. The spring's 204 outer diameter may be sized to engage the spring shoulder 408 created in the fluid lock pin housing 413 and engage the fluid cavity wall 420 without binding. The spring 204 may have a spring constant (K-value) such that it is able to apply sufficient pressure against the fluid lock pin housing 413 and movable pin 202 to move the movable pin 202 radially toward the exterior of the wellhead assembly 100 thus removing the movable pin 202 from the wellbore 110 and disengaging the internal wellhead devices. Additionally, the K-value should not be so great that a very high-pressure is required the engage the movable pin 202 to move it to toward its engaged position. One skilled in the art, would recognize the K-value needed for the spring 204 for each situation at the well site.

Additionally, an alternate embodiment may use the wellbore 110 pressure to push the movable pin 202 radially toward the exterior of the wellhead assembly 100 and disengage the wellhead device in the wellbore 110. The pin head 404 may also have an attachment point including but not limited to, threaded, j-lock, and snap lock attachments for an external mechanical removal device.

Preferably, a threaded pin retainer 206 is removably affixed to the fluid lock pin housing 413 on the exterior side of the wellhead assembly 100. The threaded pin retainer 206 has attachment point of sufficient size to allow fluid 304 to flow freely toward the movable pin 202 but prevents the movable pin 202 from exiting the fluid lock pin housing 413 when it is under pressure. In the preferred embodiment, the threaded pin retainer 206 may be a hollow cylinder with a depth sufficient to substantially fill the threaded pin retainer cavity 414 and having threads on the exterior of the threaded pin retainer 206 to cooperatively engage the threads of the pin retainer cavity 414 in the fluid lock pin housing 413 and further having threads on the interior surface of the threaded pin retainer 206 to cooperatively engage the threaded check valve 208. Other methods may be used to retain the threaded pin retainer 206 in the desired position including, but not limited to a snap ring.

The threaded pin retainer 206 may have an attachment point within the hollow cylinder allowing for insertion and removal into the pin retainer cavity 414. Preferably, the threaded pin retainer 206 may be installed or removed using an Allen wrench, by placing an Allen wrench in the Allen socket rigidly and concentrically affixed within the threaded pin retainer 206. This Allen socket in the threaded pin retainer 206 fluidly connects the pressure connection 210 of a threaded check valve 208 to the pin head 404 of the movable pin 202. It would be apparent to one skilled in the art that other methods in addition to an Allen drive such as a torx head, square head or other known drivers could be used to install and remove threaded pin retainer 206.

A threaded check valve 208 is removably affixed to the threaded pin retainer 206 by cooperatively engaging the exterior threads on the threaded check valve 208. The threaded check valve 208 allows fluid 304 to flow from the pressure connection 210 through a threaded check valve 208 to engage the movable pin 202. This threaded check valve 208 fluidly connects the fluid pump 800 to a fluid lock pin housing 413. Once pressure is released from the pressure connection 210 the threaded check valve 208 maintains the desired pressure against the movable pin 202. In the preferred embodiment, the threaded check valve 208 may be a ball-style check valve to maintain the pressure, however other types of check valves are available for use by one skilled in the art. One skilled in the art may also consider types connection for the pressure connection 210, including but not limited to, quick-disconnects that may allow the user to more quickly connect and disconnect a set of hoses from the fluid lock pin assembly 200. Finally, a threaded cap 212 may be connected to the pressure connection 210 to prevent debris from obstructing the threaded check valve 208 and to also maintain pressure if a leak in the check valve 208 was to occur.

Figure 3:
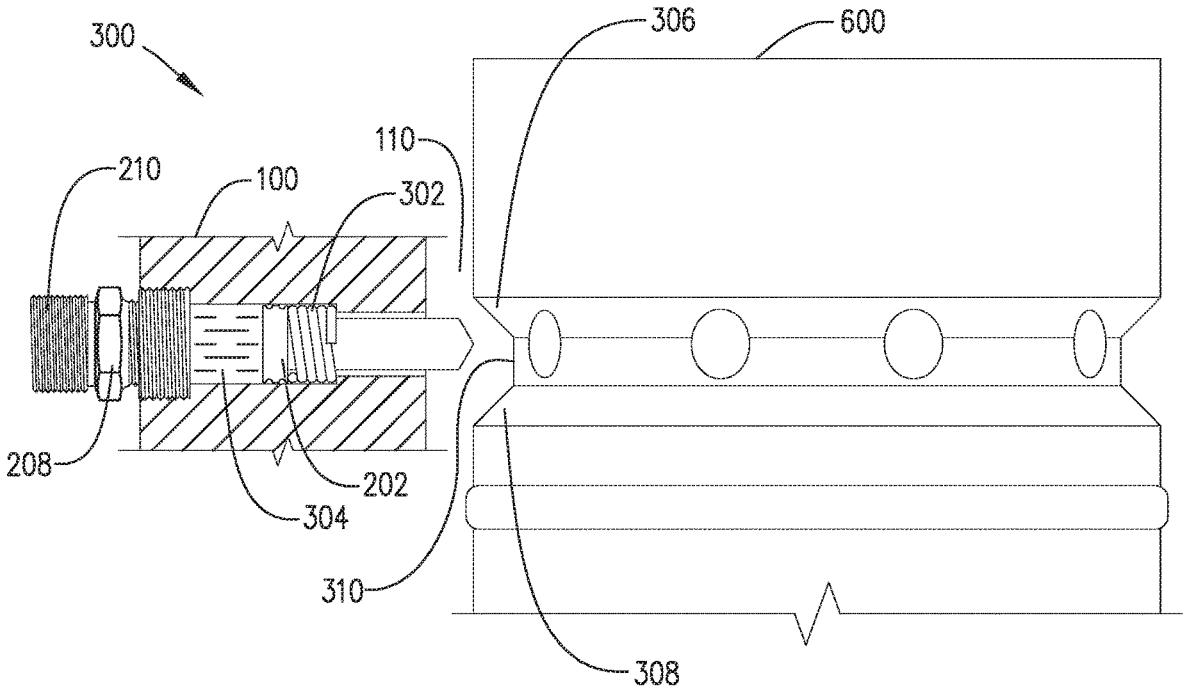
FIG. 3 is a partial sectional view of a pressurized fluid lock pin in a wellhead assembly engaging an exemplar pack-off.

FIG. 3 is a partial cross-sectional side view of a pressurized fluid lock pin assembly 300 with a compressed spring 302 and the movable pin 202 protruding into a wellhead assembly 100 engaging a pack-off 600. In this view, a pressurized fluid 304 has been applied through the threaded check valve 208 to the pin head 404 where the movable pin 202 is pushed radially through the fluid pin housing 413 toward the wellbore 110 compressing the spring 204. The compressed spring 302 allows the movable pin 202 to extend into the wellbore 110. The movable pin 202 protrudes through the wellbore 110 and as an exemplar may engage a pack-off 600 at the pack-off upper engagement surface 306, the pack-off lower engagement surface 308 or the vertical engagement surface 310. Once the pressurized fluid lock pin assembly 300 engages the pack-off 600 it prevents movement both laterally and longitudinally within the wellhead assembly 100. The pack-off 600 may be under significant pressure from the well and these pressurized fluid lock pins 300 prevent the pack-off 600 from exiting the wellhead assembly 100 longitudinally. The number of lock pins 200 that are required to adequately secure the wellhead device may be dependent on the pressure of the well and the capacity of each lock pin 200.

Once the fluid lock pin housing 413 has been pressurized with fluid 304, the fluid 304 remains within the fluid lock pin housing 413 as described above by means of a threaded check valve 208 that prevents a pressure release of the fluid 304. The fluid 304 used to dislocate the movable pin 202 may be selected from a liquid or a gas. These fluids and gases may include but are not limited to vegetable oil, canola oil, transmission fluid, hydraulic fluid, and even a compressed nitrogen. In a preferred embodiment, a vegetable oil that is environmentally friendly is used to maintain the pressure of the fluid lock pin assembly 200 in the desired operating position. To release the fluid 304 pressure from the pin head 404, one skilled in the art may use a specialized tool (not shown) to press the ball in the threaded check valve 208 inward allowing the pressurized fluid 304 to flow past the ball and exit through the pressure connection 210 on the threaded check valve 208. Upon release of the pressure, the spring 204 decompresses and retracts the movable pin 202 from the wellbore 110.

Figure 4:
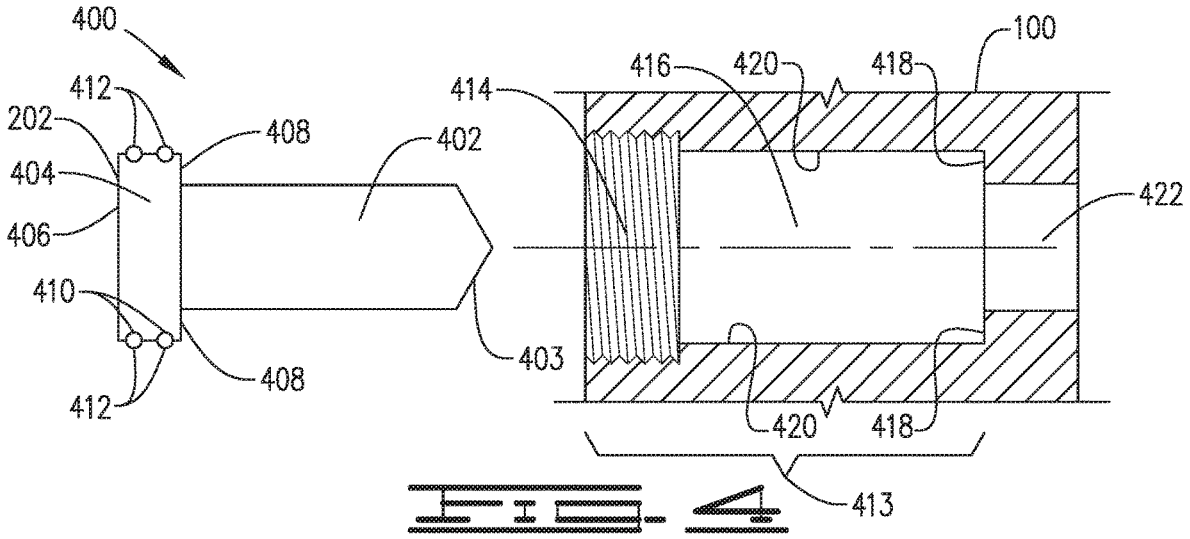
FIG. 4 is an exploded view of the movable pin and the lock pin housing.

FIG. 4 is an exploded view 400 of the movable pin 202, and the fluid lock pin housing 413, where the movable pin 202 has been disengaged from the fluid lock pin housing 413. The movable pin 202 may comprise of a pin shaft 402, a nose 403, pressure engagement surface 406 and a pin head 404, with O-ring grooves 410. The pin shaft 402 is preferably cylindrical with the conical nose 403. Rigidly and concentrically affixed to the pin shaft 402 may be a pin head 404. However, one skilled in the art prefer a different geometric configuration for both the pin shaft 402, and the nose 403.

The pin head 404 is preferably cylindrical and substantially extends across the diameter of the fluid cavity 416. One skilled in the art may choose a different geometric configuration for the pin head 404. In the preferred embodiment, the pin head 404 has two O-ring grooves 410, where O-rings 412 are placed in the O-ring grooves 410 to prevent fluid 304 from coming from the wellbore 110 and pushing the movable pin 202 out and preventing the pressurized fluid 304 from leaking past the O-rings 412, thereby reducing the pressure maintaining the fluid lock pin assembly 200 in place. One skilled in the art may choose different O-rings for sealing or potentially a different type of seal. On the opposing side of the pin head 404, from the spring shoulder 408, is a pressure engagement surface 406. The pressurized fluid 304 engages the pin head 404 at the pressure engagement surface 406, where the movable pin 202 is radially displaced from the exterior of the fluid lock pin housing 413 to the interior of the fluid lock pin housing 413 with the pin shaft 402 protruding into the wellbore 110.

On the pin shaft 402 side of the pin head 404 is a spring shoulder 408 where the spring 204 engages the movable pin 202. The pin head 404 compresses the spring 204, using the spring shoulder 408 and the pin retention shoulder 418. As the spring 204 is compressed the pin shaft 402 extends into the wellbore 110, to engage one of the wellhead devices described above. Additionally, the spring 204 prevents the movable pin 202 from extending too far into the wellbore 110. However, if the spring 204 was to fail, the pin head 404, would impact the pin retention shoulder 418, described below, and prevent the movable pin 202 from extending too far into the wellbore 110 and potentially being lost within the wellbore 110.

FIG. 4 also illustrates a cross sectional view of the fluid lock pin housing 413. In the preferred embodiment, the fluid lock pin housing 413 has three concentric hollow cylinders, that step down in size from the exterior end, at the external part of the wellhead assembly 100, to the interior end at the wellbore 110. The first hollow cylinder is a pin retainer cavity 414, where in the preferred embodiment, the pin retainer cavity 414 is threaded internally to cooperatively engage the threaded pin retainer 206. The next hollow cylinder is the fluid cavity 416 and the different radii between the pin retainer cavity 414 and the fluid cavity 416 creates a shoulder that prevents the pin retainer 206 from being threaded in too far. The threaded pin retainer 206 is rotated, engaging the threads in the pin retainer cavity 414 until the threaded pin retainer 206 reaches the fluid cavity 416.

The second concentric cylinder creates a fluid cavity 416 that retains and maintains the fluid 304 at the desired pressure. The pin head 404, and a portion of the pin shaft 402 positioned inside the spring 204, reside within the fluid cavity 416, wherein the movable pin 202 moves radially within the fluid cavity 416. Within the fluid cavity 416, the fluid cavity wall 420 engages the O-rings 412 to maintain the seal between the fluid cavity 416 and the wellbore 110.

The third concentric cylinder, known as the shaft alignment housing 422 is smaller than the fluid cavity 416, The radii difference between the fluid cavity 416 and the shaft alignment housing 422 create a pin retention shoulder 418, where the spring 204 rests and the pin retention shoulder 418 may also prevent the movable pin 202 exiting through the shaft alignment housing 422 into the wellbore 110.

Figure 5:
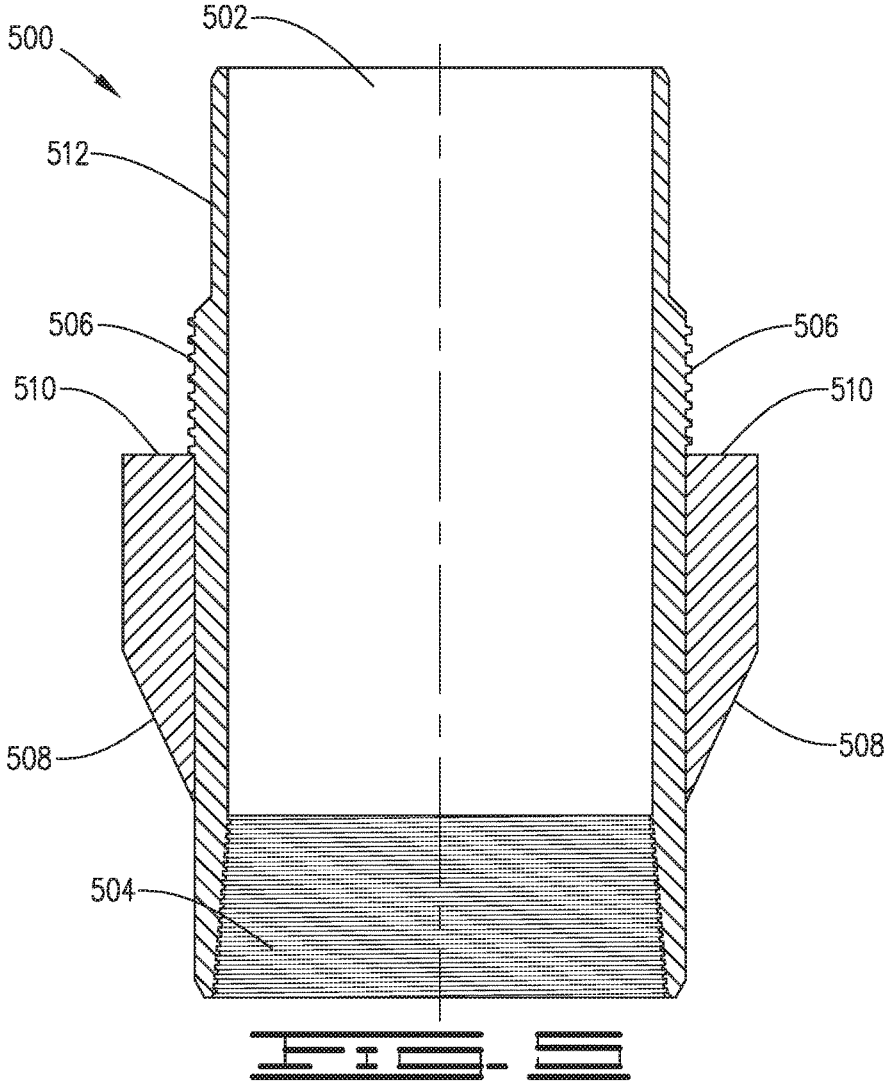
FIG. 5 is a section a view of a fluted mandrel.
Figure 5:
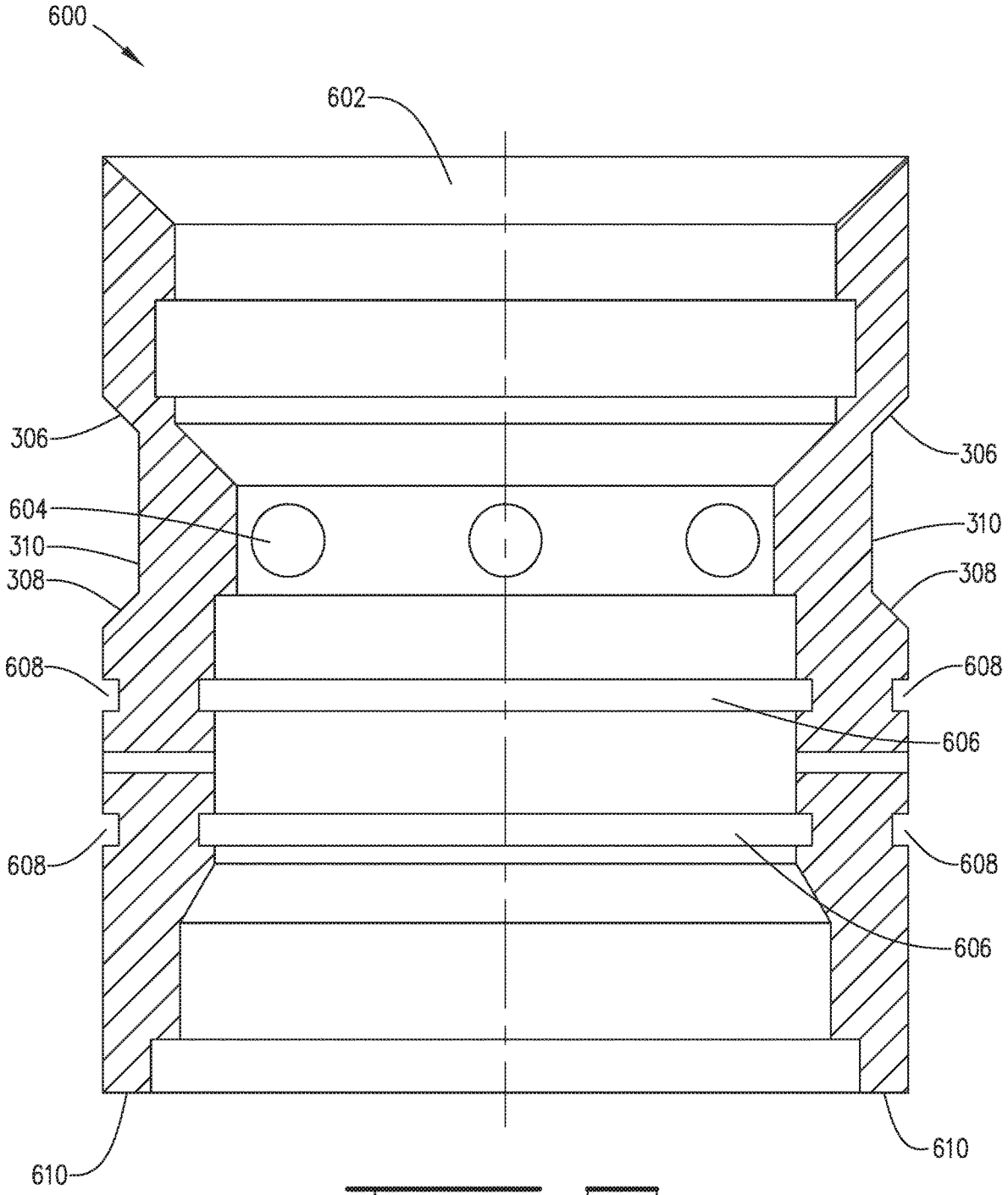

FIG. 5 is a sectional view of a fluted mandrel 500. A fluted mandrel 500 may comprise a mandrel internal passage 502, running tool threads 506, tube threads 504, a wellhead engagement surface 508, a pack-off engagement surface 510 and a tube extension 512. A fluted mandrel 500 may be rotatedly affixed to a production string 702 in the wellbore 110. This occurs when the fluted mandrel 500 is threadedly affixed to the production string 702 by the use of a running tool (not shown) that engages running tool threads 506 where the user operating the running tool places the fluted mandrel 500 down inside the wellhead assembly 100 and running tool is rotated to thread the tube threads 504 onto the production string 702 cooperative threads and the user lands the fluted mandrel 500 inside the wellhead assembly 100 on a wellhead shoulder 706 within the wellhead assembly 100. For the landing, the wellhead engagement surface 508 engages the wellhead shoulder 706 within the wellhead assembly 100 thus preventing the fluted mandrel 500 from slipping down inside the wellbore 110 and allowing the production string 702 to be suspended from the fluted mandrel 500.

Once the fluted mandrel 500 is placed in the desired position, a pack-off 600 (described below) is placed over the fluted mandrel 500 where it rests on the pack-off engagement surface 510 sealing the annulus 704. Upon completion, hydrocarbons may flow up and through a fluted mandrel 500 through the mandrel internal passage 502 up and inside the wellhead assembly 100 as well as flowing up through the annulus 704 and out through the annulus valve 106.

FIG. 6 is a sectional view of a pack-off 600. The pack-off 600 may comprise a hollow cylinder with a pack-off internal passage 602 to accept a tube or tube extension 512, internal seal grooves 606, external seal grooves 608, pass through holes, a pack-off upper engagement surface 306 and a pack-off lower engagement surface 308, a vertical engagement surface 310 and a fluted mandrel engagement surface 610. Once a fluted mandrel 500 is landed on the shoulders of the wellhead assembly 100 then a pack-off 600 is in place around the tube extension 512 and resting on top of a fluted mandrel 500. The pack-off internal passage 602 allows the flow of hydrocarbons from the production string 702 to the valve assembly 108 mounted atop the wellhead assembly 100. Pass-through holes 604 allow the flow of hydrocarbons thru to the production string valve 108 in the wellhead assembly 100. The internal seal grooves 606 may receive an internal seal that is positioned between the pack-off 600 and the fluted mandrel 500 to prevent hydrocarbons flowing between the fluted mandrel 500 and the pack-off 600.

The external seal grooves 608 may receive seals that isolate the area between the exterior of the pack-off 600 and the wellhead assembly 100 where the pack-off 600 prevents hydrocarbon flow between the pack-off 600 and the interior of the wellhead assembly 100. The pack-off 600 then effectively seals the annulus 704 by sealing both pathways created between the wellhead assembly 100 interior and the production string 702. Hydrocarbons flowing through the annulus 704 may be from a different production zone within the wellbore 110. The pack-off 600 effectively directs the flow of the hydrocarbons to the different valve assemblies 106, 108.

The pack-off 600 has a pack-off upper engagement surface 306, a pack-off lower engagement surface 308, and vertical engagement surface 310 for the fluid lock pin assembly 200. As previously described, the pressurized movable pin 202 protrudes through the wellhead assembly 100 and engages a wellhead device. In the preferred embodiment, the pressurized movable pin 202 frictionally engages the vertical engagement surface 310 to frictionally maintain the pack-off's 600 position within the wellhead assembly 100. Additionally, the vertical engagement surface 310 is a small vertical portion of the overall pack-off 600 height and has a smaller cylindrical radii portion than the pack-off 600 external radii creating sloped transitions that are the pack-off upper engagement surface 306 and pack-off lower engagement surface 308. These surfaces 306, 308 prevent the pack-off 600 from disengaging from the pressurized lock pin 300 and creating a hazardous situation.

Figure 7:
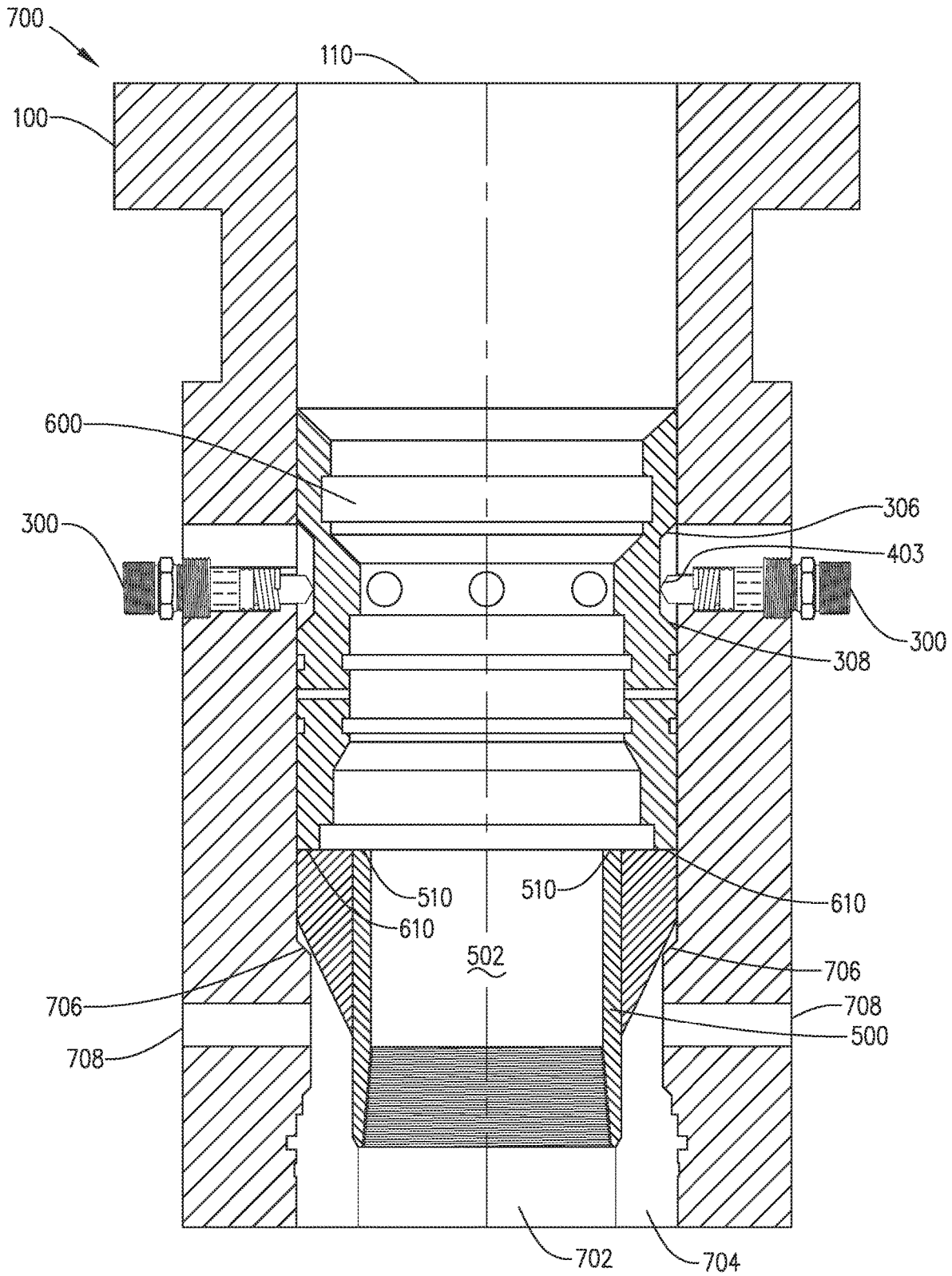
FIG. 7 is a sectional view of a wellhead assembly with a fluted mandrel and pack-off internally installed in their operational position with pressurized fluid lock pins engaging a pack-off.

FIG. 7 is a sectional view 700 of a wellhead assembly 100 with a fluted mandrel 500 and a pack-off 600 internally mounted in their operational position within the wellhead assembly 100 with pressurized fluid lock pins 300 engaging the vertical engagement surface 310 of a pack-off 600. This view illustrates the fluted mandrel 500 engaging the wellhead shoulder 706 with the fluted mandrel wellhead engagement surface 508. The pack-off 600 is then slides over the tube extension 512 of the fluted mandrel 500, where the fluted mandrel engagement surface 610 of the pack-off 600 sits on the pack-off engagement surface 510. Once the pack-off 600 is in the desired position, then the fluid lock pins 200 are energized with pressurized fluid 304 that radially displaces the movable pin 202 toward and into the wellbore 110 to engage the pack-off 600 and prevent the pack-off 600 and the fluted mandrel 500 from lifting out of the wellbore 110. This view further illustrates how the pack-off 600 and fluted mandrel 500 isolate the annulus 704 from above and directs the flow of the hydrocarbons through the annulus pass-through 708 to the annulus valve 106. The production string 702 rigidly attached to the fluted mandrel 500 allows flow of hydrocarbons up through the production string 702, through the mandrel internal passage 502 and up into the wellbore 110 and out the production string valve 108.

Figure 8:
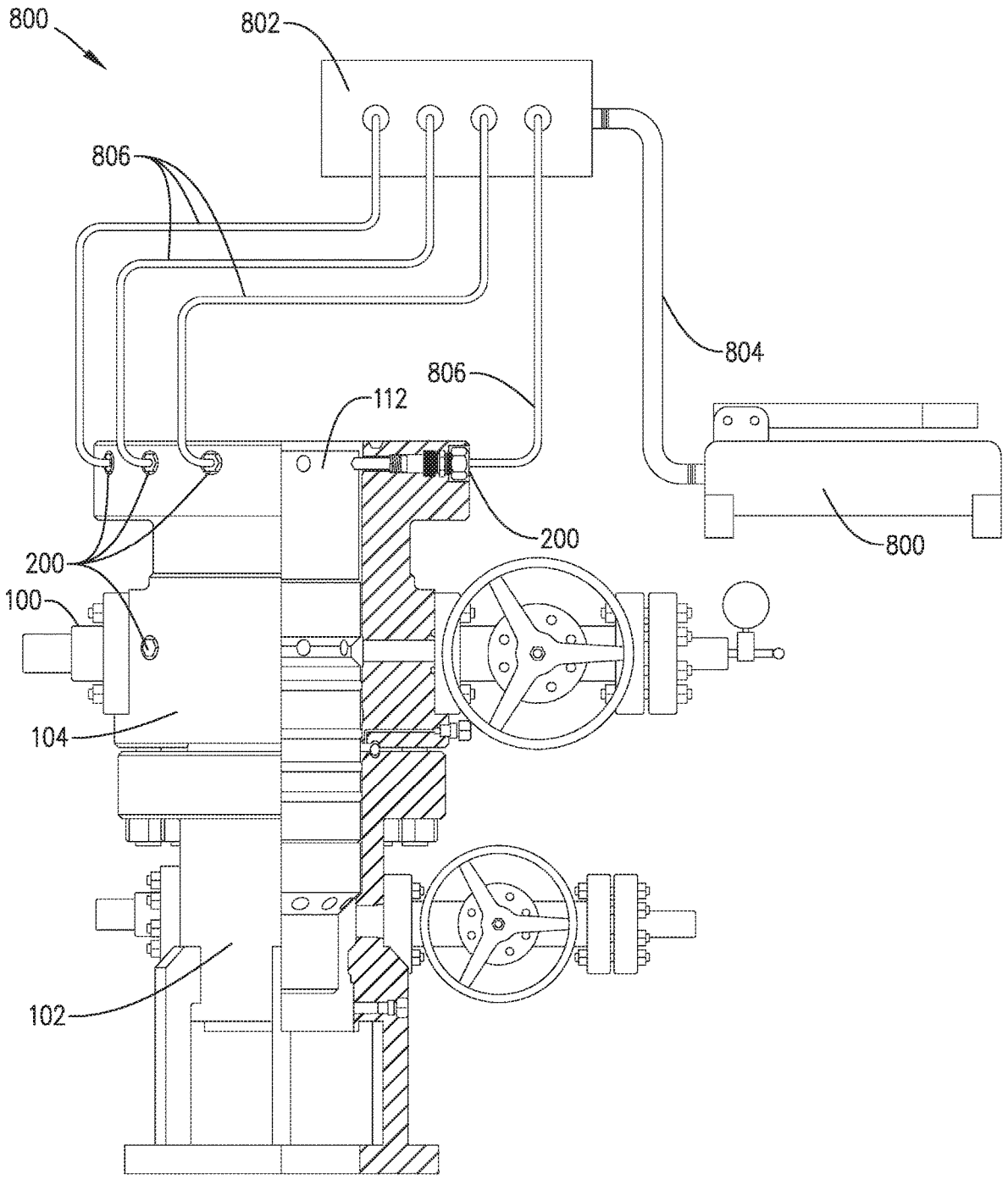
FIG. 8 is a view, half in elevation and half in longitudinal section, of the wellhead assembly showing the improved fluid lock pin apparatus with a pressure pump attached to all the associated lock pins for a particular wellhead device.

FIG. 8 is a side view, half in elevation and half in longitudinal section, of the wellhead assembly 100 showing the fluid lock pin assembly 200 with a fluid pump 800 attached to all the associated fluid lock pins 200 for a particular wellhead device. In the preferred embodiment and as shown, the user attaches a fluid pump 800 to a fluid distribution block 802 via a fluid pump hose 804 that is removably affixed through the fluid distribution block hoses 806 to the fluid lock pins 200 associated to a tubing hanger 112 in the upper part of the wellhead assembly 100. The user activating the fluid pump 800 pressurizes the fluid 304 which is then distributed to the individual fluid lock pins 200 using the fluid distribution block 802 and moves all the movable pin 202 radially toward the wellbore 110 simultaneously to engage the tubing hanger 112. Once all the pressurized fluid lock pins 300 have engaged the wellhead device, the user may depressurize the fluid pump 800, detach the fluid pump 800 and fluid distribution block 802 from the wellhead assembly 100. In an alternate embodiment, the user may use the fluid pump 800 only and pressurize the fluid lock pins 202 individually. This method may also be used for the maintenance and replacement of a fluid lock pin assembly 200.

I claim:

1. A fluid-actuated lock pin apparatus for securing wellhead devices within a wellhead assembly, the apparatus comprising:

a movable lock pin;

at least one radial cylindrical passage in the wellhead assembly configured to accept the movable lock pin, the at least one radial cylindrical passage comprising:

at least one interior retainer configured to limit the distance the movable lock pin protrudes into a wellbore, at least one exterior retainer configured to prevent the lock pin from externally exiting the at least one radial cylindrical passage, and a fluid cavity, disposed between the at least one interior retainer and the at least one exterior retainer, configured to receive and retain a pressurized fluid that directly engages the movable lock pin;

a fluid in direct contact with the movable lock pin and a pressure control device;

a pressure means for pressurizing the fluid;

the pressure control device configured to retain the fluid in direct contact with the movable lock pin and at a pressure to maintain the lock pin in an engaged position; and at least one internal pin retractor configured to disengage the lock pin from the wellbore upon release of pressure, whereby the apparatus is configured to apply hydraulic pressure directly to the movable lock pin whereby the movable lock pin is displaced inside the radial passage in the wellhead assembly and extended into the wellbore to engage and hold fixedly in place an internal wellhead device, until the pressure is released.

2. The apparatus of claim 1, where the at least one radial cylindrical passage has multiple radii within the passage.

3. The apparatus of claim 2, where the radii of the at least one radial cylindrical passage is stepped down from the exterior of the wellhead assembly to the wellbore.

4. The apparatus of claim 3, where the at least one cylindrical radial passage has three radii.

5. The apparatus of claim 1, where the internal wellhead device is selected from the group consisting of a pack-off, a hanger, a mandrel, a slip, and bushings.

6. The apparatus of claim 1, where the movable lock pin includes an attachment point for mechanically removing the movable lock pin from the at least one radial cylindrical passage.

7. The apparatus of claim 6, where the attachment point is selected from the group consisting of a threaded attachment, a j-lock attachment, and snap lock attachment.

8. The apparatus of claim 1, where interior retainer is removable.

9. The apparatus of claim 1, where the fluid is selected from the group consisting of a liquid and a gas.

10. The apparatus of claim 1, where the pressure means is selected from the group consisting of a mechanical and an electromechanical pump.

11. A fluid-actuated lock pin apparatus for securing a wellhead device within a wellhead assembly, the apparatus comprising:

at least one movable lock pin comprising:

a shaft with a distal end and a proximate end, the proximate end with a radius greater than the distal end, and at least one seal;

a removable external retainer;

at least one radial cylindrical passage in a casing head, the at least one radial cylindrical passage comprising:

a first radial cylindrical passage, a second radial cylindrical passage, and a third radial cylindrical passage; where the first radial cylindrical passage is smaller than the second radial cylindrical passage, and the second radial cylindrical passage is smaller than the third radial cylindrical passage, and the first radial cylindrical passage fluidly connects a wellbore to the second radial cylindrical passage, the second radial cylindrical passage fluidly connects the first radial cylindrical passage to the third radial cylindrical passage; and a shoulder between first and second cylindrical passages, a fluid transfer device;

a one way-check valve with a fluid port;

a fluid pump;

a spring, wherein:

the at least one radial cylindrical passage is configured to accept the at least one movable lock pin, the shoulder is configured to limit the distance the at least one movable lock pin protrudes into the wellbore;

the third radial cylindrical passage is configured to accept the removable external retainer, which is in-turn configured to prevent the at least one movable lock pin from exiting the at least one radial cylindrical passage, the third radial cylindrical passage is further configured to fluidly connect the second passage to the fluid transfer device;

a fluid cavity is formed, disposed between the shoulder and the removable external retainer, and configured to receive and retain a pressurized fluid that directly engages the at least one movable lock pin; wherein when the at least one movable lock pin is in an engaged position;

the distal end of the shaft substantially fills the first radial cylindrical passage, and extends into the wellbore with at least one surface configured to cooperatively engage an internal device within the casing head, the proximate end of the shaft axially fills the second radial passage and is configured to engage the pressurized fluid in the fluid cavity, the at least one seal is configured to prevent fluid from escaping from the fluid cavity;

the fluid is directly connected to the at least one movable lock pin and the one way-check valve; and whereby the apparatus is configured to receive pressurized fluid from the fluid pump to the fluid port and apply the pressurized fluid to the movable lock pin where the movable the lock pin is displaced inside the at least one radial cylindrical radial passage in the well head assembly to the engaged position to engage an internal device within the wellbore, the one way-check valve configured to maintain the fluid pressure to maintain the lock pin in the engaged position, and hold the movable lock pin fixedly in place until the pressure is released.

* * * * *